US005514343A

United States Patent [19]

Verwohlt et al.

[11] Patent Number: 5,514,343

[45] Date of Patent: May 7, 1996

[54] MICROTITRATION SYSTEM

[75] Inventors: Henrik B. Verwohlt, Roskilde; Bjorn G. Larsen, Bagsvaerd; Peter Esser, Kobehavn; Arne Johansson, Jyllinge, all of Denmark

[73] Assignee: Nunc, AS, Roskilde, Denmark

[21] Appl. No.: 263,534

[22] Filed: Jun. 22, 1994

[51] Int. Cl.[6] ..... B01L 9/00

[52] U.S. Cl. ..... 422/104; 422/102; 435/288.4; 215/364; 211/74; 211/76; 220/23.83; 220/23.86

[58] Field of Search ..... 422/102, 104, 422/101; 435/301, 293, 300; 206/558, 560; 220/23.83, 23.86; 211/126, 74, 76

[56] References Cited

U.S. PATENT DOCUMENTS

| | | | |
|---|---|---|---|
| Re. 34,133 | 11/1992 | Thorne | 422/99 |
| 3,356,462 | 12/1967 | Cooke et al. | 23/292 |
| 3,388,807 | 6/1968 | Emmitt | 211/74 |
| 3,415,361 | 12/1968 | Adams, Jr. et al. | 206/47 |
| 3,441,383 | 4/1969 | Moore et al. | 23/292 |
| 3,504,376 | 3/1970 | Bednar et al. | 23/230 |
| 3,540,858 | 11/1970 | Rochte et al. | 23/292 |
| 3,649,462 | 3/1972 | Jessup . | |
| 3,649,464 | 3/1972 | Freeman | 195/140 |
| 3,682,597 | 8/1972 | Husch | 23/259 |
| 3,724,654 | 4/1973 | Gerard et al. | 206/72 |
| 3,759,374 | 9/1973 | Helger et al. | 206/65 |
| 3,778,232 | 12/1973 | McMorrow, Jr. | 23/253 |
| 3,806,422 | 4/1974 | Moyer et al. | 195/103.5 R |
| 3,907,505 | 9/1975 | Beall et al. | 23/259 |
| 3,940,249 | 2/1976 | McClurg | 23/230 |
| 4,038,149 | 7/1977 | Liner et al. | 195/127 |
| 4,735,778 | 4/1988 | Maruyama et al. | 422/102 |
| 4,797,259 | 1/1989 | Matkovich et al. | 422/101 |
| 4,828,386 | 5/1989 | Matkovich et al. | 356/246 |
| 4,968,625 | 11/1990 | Smith et al. | 435/301 |
| 5,047,215 | 9/1991 | Manns | 422/101 |
| 5,096,672 | 3/1992 | Tervamaki et al. | 422/102 |
| 5,112,574 | 5/1992 | Horton | 422/102 |
| 5,219,528 | 6/1993 | Clark | 422/101 |
| 5,273,718 | 12/1993 | Skold et al. | 422/101 |
| 5,308,584 | 5/1994 | Vauramo | 422/104 |

FOREIGN PATENT DOCUMENTS

| | | |
|---|---|---|
| 2089512 | 1/1972 | France . |
| 2225062 | 10/1974 | France . |
| 2051581 | 3/1972 | Germany . |
| 758517 | 10/1956 | United Kingdom . |

*Primary Examiner*—Timothy M. McMahon
*Assistant Examiner*—N. Bhat
*Attorney, Agent, or Firm*—Klein & Szekeres

[57] ABSTRACT

A microtitration system comprises a plurality of well and a frame-like holder with apertures for receiving the wells. Each well has a bottom wall and a side wall extending upwardly therefrom so as to define an upper open end, and a depression or groove is formed in an outer surface of the well side wall at a position spaced from the bottom wall. Each aperture of the holder is at least partly defined by a resilient aperture defining means, which is adapted to enter into locking engagement with the depression or groove of a well received in the aperture. The dimensions and the shape of each aperture are such that when a well is inserted into the aperture, the aperture defining means is engaging with the outer surface of the well side wall and is pressed radially outwardly in relation to a central axis of the well till the aperture defining means may snap into locking engagement with the depression or groove formed in the side wall of the well.

23 Claims, 2 Drawing Sheets

MICROTITRATION SYSTEM

BACKGROUND OF THE INVENTION

1. Field of the Invention

This invention relates to a microtitration system for use in the conducting of body fluid investigations, such as diagnostic measurements.

2. Prior Art

U.S. Pat. No. 4,154,795 discloses a microtitration plate formed by a plurality of wells which are integrally connected to one another by rigid, breakable stems. The wells are arranged in straight rows extending at right angles in relation to each other, and a desired number of wells may be removed from the plate by breaking the breakable stems. The wells—whether separated or not—may be arranged in a tray having an array of posts extending upwardly from the bottom of the tray. These posts define a plurality of squares, and a well may be received in each square and may engage with adjacent posts so that it is retained in the tray by frictional forces.

U.S. Pat. No. 5,096,672 discloses a similar microtitration plate and a corresponding tray or holder with a grid-like structure defining well receiving openings or apertures. A wall of each of the substantially square apertures is severed to provide a flexibly deformable clamping element for frictionally engaging and holding the well received in the aperture. None of these known well receiving tray structures may ensure that a well is safely received in a well receiving aperture so that the well does not unintentionally fall out when the tray and the wells received therein are moved or turned upside down, for example during a washing step.

SUMMARY OF THE INVENTION

The present invention provides a microtitration system in which the retention of wells, which are received in apertures defined in a frame-like holder, has been substantially improved.

Thus, the present invention provides a microtitration system comprising a plurality of wells or cuvettes each having a bottom wall and a side wall extending upwardly therefrom so as to define an upper open end, a depression or groove being formed in an outer surface of the well side wall at a position spaced from the bottom wall, and a frame-like holder defining a plurality of apertures for releasably receiving the wells therein, each aperture being at least partly defined by a resilient aperture defining means, which is adapted to enter into locking engagement with the depression or groove of a well received in the aperture, the dimensions and the shape of each aperture being such that when inserting a well into the aperture the aperture defining means is engaging with the outer surface of the well side wall and is pressed radially outwardly in relation to a central axis of the well till the aperture defining means may snap into locking engagement with the depression or groove formed in the side wall of the well.

In the microtitration system according to the invention each well is positively locked to the frame-like holder in its fully inserted position. Because of the snap fastener like locking of a well being inserted into the holder, a user of the system may readily ascertain when the well has been fully inserted in the frame-like holder and is positively retained therein.

The resilient aperture defining means may still be stressed to a certain extent when they are in locking engagement with the depression or .groove. When the resilient aperture defining means are maintained in a stressed condition for a long period of time it may loose some of its resiliency. Therefore, in the preferred embodiment of the system according to the invention the cross-sectional dimensions of the groove are such that the resilient aperture defining means is substantially unstressed when engaging with the groove, whereby the resiliency of the aperture defining means may remain substantially unchanged during a prolonged period of use.

Each well or cuvette may have any suitable cross-sectional shape. As an example, the wells may have a polygonal, such as a rectangular or square outer cross-section. In such case, the depression or groove may be formed in at least one side surface of the polygonal well, and the side surface with the depression or groove may then be arranged opposite to the resilient aperture defining means when the well is inserted into one of the apertures defined in the frame-like holder. However, the groove is preferably annular so that it may extend along the total outer periphery of the side wall of the well. In such case, the depression or groove is inevitably positioned opposite to the resilient aperture defining means when the well is inserted into an aperture of the holder. Furthermore, the outer surface of the side wall of each well is preferably a surface of revolution so that the well may be inserted into an aperture of the holder in any angular position.

The resilient aperture defining means could be withdrawn from the depression or groove of a well received in the aperture against the bias of the resilient means by manually operateable or other suitable means so as to allow withdrawal of the well from the aperture of the holder. In the preferred embodiment, however, the depression or groove may be defined by an inner groove bottom wall, an upper groove side wall, and a lower groove side wall of which side walls the latter defines an acute angle with a central axis of the well so as to facilitate withdrawal of the well from the holder. When the well is exposed to an axially directed withdrawal force, the obliquely extending lower side wall of the groove defines a cam surface or ramp surface for forcing the resilient aperture defining means out of engagement with the groove.

In order to facilitate insertion of a well in one of the apertures defined by the frame-like holder, the well preferably tapers towards its bottom end. Thus, the well may have a bevelled bottom edge and/or the outer surface of the side wall of the well may have a conical shape or otherwise taper in a direction from the depression or groove towards the bottom end of the well or cuvette.

The aperture defining means may comprise any kind of resilient latch means which may engage with the outer side wall of a well being inserted into an aperture of the frame-like holder, and which may snap into engagement with the depression or groove when the well has been fully inserted. As an example, the resilient aperture defining means may comprise a spring-biassed latch member, such as a pin or ball displaceably mounted in a bore or a wall part defining an aperture of the frame-like holder. However, preferably the aperture defining means comprises a resiliently flexible arm formed integrally with the frame-like holder. Thus, for example, the frame-like holder may be of the type disclosed in FIGS. 2 and 3 of U.S. Pat. No. 5,096,672.

The resiliently flexible arm may have such a thickness and shape that it may engage along part of its length with the depression or groove of the well. However, the flexible arm preferably has a latch member formed integrally therewith and projecting from the free end of the arm for engaging with the depression or groove formed in the side wall of the well. In such case, only the latch member needs to be shaped so that it may engage with the depression or groove while the remaining part of the flexible arm may have any desired cross-sectional dimensions.

In principle, the apertures defined by the frame-like holder may form any desired pattern or array. However, the apertures defined by the frame-like holder are preferably arranged in sets of parallel rows extending at right angles to each other in accordance with common practise. Adjacent rows may be separated by a continuous, elongated frame member formed integrally with the frame-like holder, and adjacent apertures in the same row may be separated by a pair of oppositely directed flexible arms having their free ends mutually spaced.

Initially, a number of wells corresponding to the number of apertures in each row may be mutually interconnected by breakable connecting means so as to form a straight row. Furthermore, a number of such rows may be arranged in parallel and interconnected by breakable connecting means so as to form a conventional microtitration or microtest plate or cuvette matrix. The wells or cuvettes of such plate or matrix may be arranged in rows extending at right angles in relation to each other, and each plate may, for example, contain 8×12 wells or cuvettes.

When the wells or cuvettes are arranged in parallel rows each well may comprise a radial flange which extends from the upper end of the well and which is provided with markings or indexes for indicating the position of each well in the row. As an example, such markings may be in the form of colors or color combinations, numbers, letters, dots or any other sign. Preferably, however, such markings or indexes comprise notches defined in the radial flange. These markings or indexes may be used for determining the correct position of a well or cuvette in a corresponding holder when the wells or cuvettes have been broken apart.

According to another aspect the present invention also provides a well or cuvette for use in a microtitration system as described above and having a bottom wall and a side wall extending upwardly therefrom so as to define an upper open end, a depression or groove being formed in the outer surface of the side wall of the well at a position spaced from the bottom wall, said depression or groove being adapted to receive a resilient latch member of a well holder when the well or cuvette is positioned in a well receiving opening defined in the holder. A plurality of such wells may be arranged in a straight row and mutually interconnected by breakable connecting means, and a number of such rows may in turn be mutually interconnected by breakable connecting means so as to define a plate or matrix of wells or cuvettes.

According to a further aspect the present invention defines a plurality of wells or cuvettes for use in a microtitration system and being arranged in a straight row and mutually interconnected by breakable connecting means, each well having a bottom wall and a side wall extending upwardly therefrom so as to define an upper open end, a radial flange extending from said upper end being provided with markings or indexes indicating the position of each well in the row. Such markings or indexes may, for example, comprise notches defined in the radial flange.

BRIEF DESCRIPTION OF THE DRAWINGS

The invention will now be further described with reference to the drawings, wherein.

DESCRIPTION OF A PREFERRED EMBODIMENT

Figure 1:
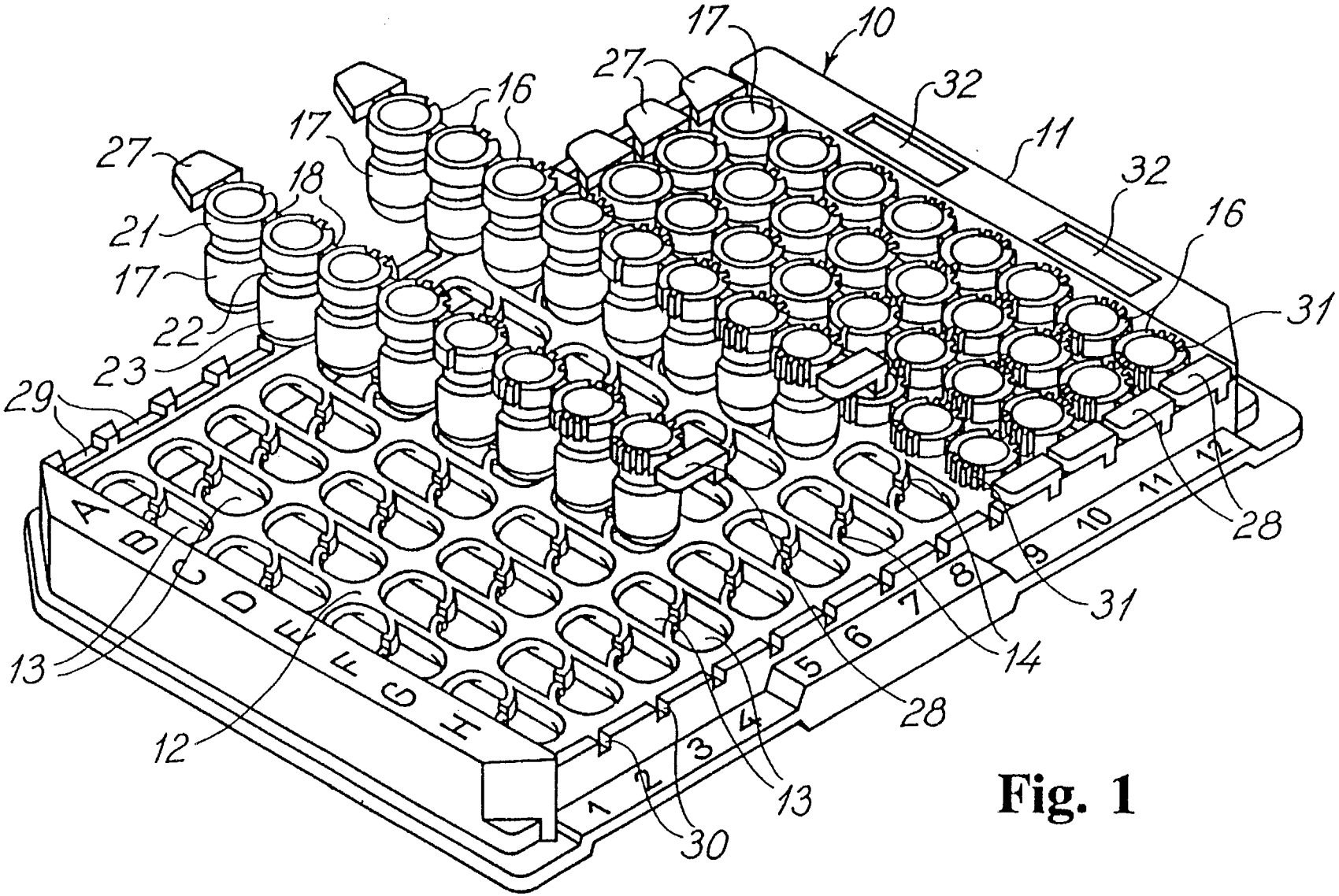
FIG. 1 is a top perspective view of an embodiment of the microtitration system according to the invention.

The microtitration system shown in the drawings comprises a substantially rectangular frame-like holder or tray 10 which is formed integrally from a suitable plastic material, such as a polymeric or copolymeric plastic material, for example acrylic butadiene styrene. The holder 10 comprises a frame part 11 defining the sides of the rectangular holder 10 and a flat wall 12 extending inside the frame part 11. The flat wall 12 defines a plurality of well receiving openings or apertures 13 therein.

Figure 2:
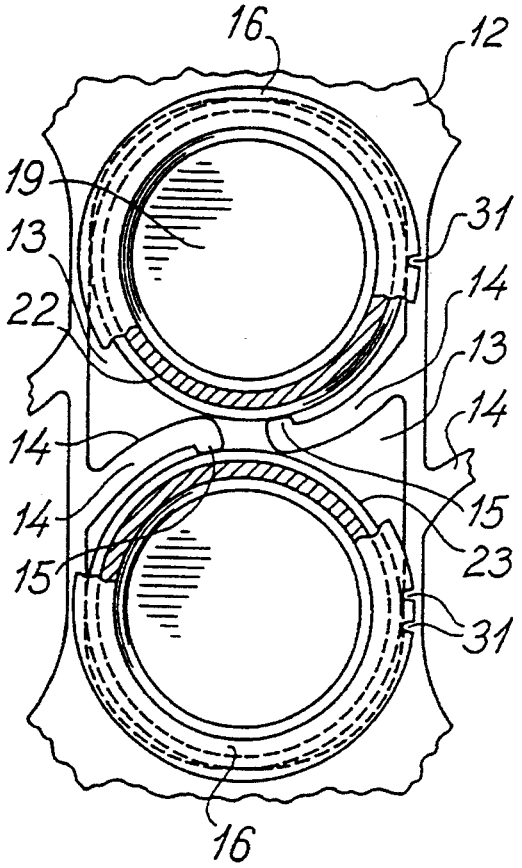
FIG. 2 is a fragmentary top plan and partially cross-sectional view showing in an enlarged scale a pair of wells which have been partly inserted in apertures of a well holder.
Figure 3:
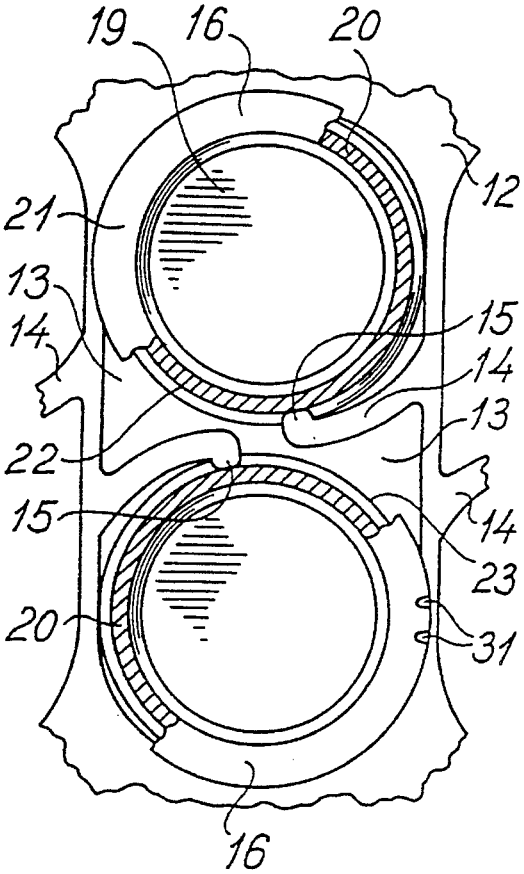
FIG. 3 illustrates the same as FIG. 2, the wells being shown in their fully inserted position.

These openings or apertures 13 are arranged in two sets of parallel rows extending at mutually right angles. The rows in a first set of these rows are indicated by consecutive letters A–H on the frame part 11, while the rows in a second set of these rows are indicated by consecutive numbers 1–12. The apertures 13 in each of said second set of rows are arranged in pairs, and the openings or apertures 13 of each pair is separated by oppositely directed, resilient arms 14 having opposite, spaced free ends as best shown in FIGS. 2 and 3. A latch member 15 is integrally formed at the free end of each arm 14, and the latch members 15 formed on each pair of oppositely directed arms 14 separating a pair of adjacent openings 13 are directed oppositely towards the centre of the adjacent aperture or opening 13.

The microtitration system further comprises a plurality of micro-test wells, tubes or cuvettes 16, which are preferably arranged in straight rows 17 and which are mutually interconnected by breakable connecting parts or stems 18 in a known manner. If desired, a plurality of straight rows 17 of wells 16 may in turn be interconnected by breakable interconnecting parts or stems so as to form a plate-like arrangement of wells with two sets of rows extending at mutually right angles and corresponding to the arrangement of openings or apertures 13 in the wall 12 of the holder 10.

Figure 4:
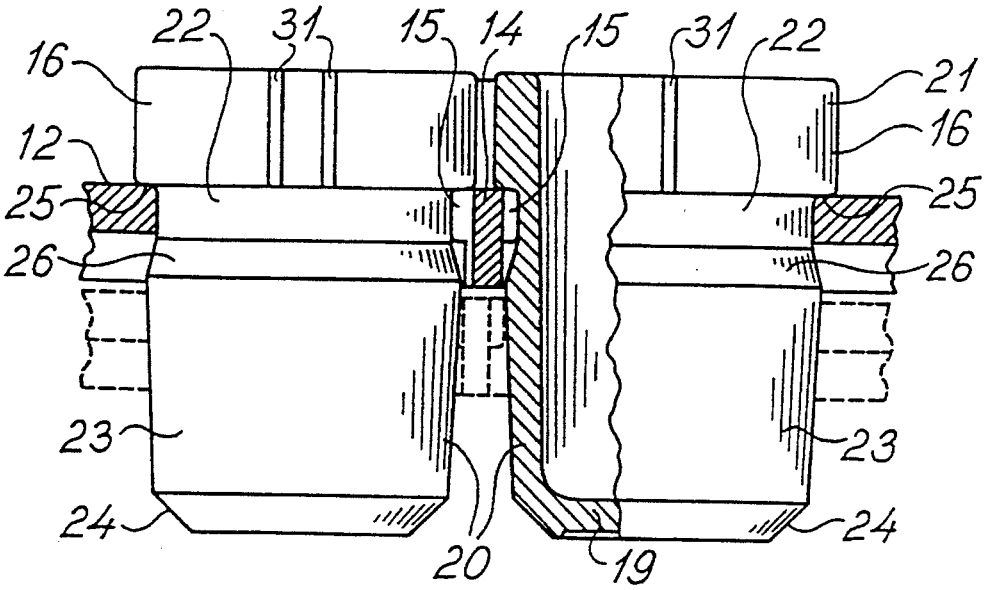
FIG. 4 is a side view and partial sectional view of the wells shown in FIGS. 2 and 3.

The wells or cuvettes 16 are preferably made from a transparent plastic material, such as polystyrene, and as best shown in FIG. 4 each well 16 comprises a flat bottom wall 19 and a side wall 20 extending upwardly therefrom so as to define an upwardly open well or cuvette. Each well or cuvette 16 has a radially outwardly directed collar or flange 21 at its upper end, and a peripherally extending, annular channel or groove 22 is formed in the outer surface of the well side wall 20 immediately below the collar or flange 21. The outer surface of the well side wall 20 also defines a downwardly tapered surface part 23, and the well side wall 20 may be chamfered at its bottom end at 24. The collar or flange 21 may define a downwardly directed shoulder 25 which preferably extends at substantially right angles to the central axis of the well and which forms an annular upper side wall of the channel 22. A lower annular side wall 26 preferably slopes downwardly so as to define an acute angle with the central axis of the well.

When a well or cuvette 16 of the type described above is to be inserted in an opening or aperture 13 of the holder 10, the chamfered bottom end of the well is positioned above the opening while the well is pressed axially downwardly. The latch member 15 of the arm 14 defining the opening or aperture 13 then comes into engagement with the tapered outer surface part 23 of the well as shown in FIG. 2 and indicated in broken lines in FIG. 4. When the well 16 is pressed downwardly the surface part 23 functions as a ramp forcing the latch member 15 and its flexible arm 14 radially outwardly till the latch member reaches the sloping annular side wall 26 of the channel or groove 22. Then, the latch member 15 will snap into engagement with the channel or groove 22 under the bias of the fixed resilient arm 14, whereby the well 16 is locked in a fixed mutual axial position in relation to the holder 10, vide FIGS. 3 and 4. The thickness of the latch member 15, which is preferably smaller than the thickness of the adjacent part of the arm 14, substantially corresponds to the axial width of the bottom of the channel or groove 22.

The radial depth of the channel or groove 22 is preferably such that when the latch member 15 is in engagement therewith, the corresponding arm 14 is substantially unstressed. It should be understood that the wells or cuvettes 16 may be inserted into the holder 10 one at a time, or a straight row 17 of interconnected wells may be inserted at the same time, or two or more such rows may be inserted at the same time. Each of the oppositely directed arms 14 separating adjacent apertures 13 in a pair of such apertures, is shaped and arranged such that it does not interfere with a well or cuvette 13 being inserted into the neighbouring aperture.

When a well or cuvette 16 is to be withdrawn from the holder 10, an upwardly directed axial force is applied to the well or cuvette. The latch member 15 will then be moved into engagement with the sloping lower channel side wall 26 which may serve as a ramp forcing the latch member radially outwardly against the resilient bias of the corresponding arm 14. When the latch member 15 comes into engagement with the tapered outer surface part 23, the resilient bias of the arm assists in pressing the well 16 out from the opening or aperture 13.

As shown in FIG. 1 each of the straight rows 17 of wells or cuvettes 16 may at each end be provided with extensions or lugs 27 and 28 each of which is connected to the adjacent well 16 by breakable connecting means. Such extensions or lugs may be received in corresponding recesses or pockets 29 and 30, respectively, when the wells of the row are inserted into a corresponding row of openings or apertures 13 of the holder 10.

The wells 16 in each row 17 is provided with markings identifying the position of the well in the row. In the embodiment shown these markings comprise notches 31 in the collar or flange 21. In the embodiment shown the number of notches in the collar 21 of a specific well 16 indicates the position of the well in the row 17. Thus, the first well in a row may have a single notch 16, the second well may have two notches, etc. The marking of the wells in a row renders it possible to position the well in a correct aperture or opening 13 also when the wells in the row have been broken apart.

The frame part 11 of the holder 10 may define flat fields 32 for carrying trademarks, trade names or other information.

It should be understood that various amendments and modifications of the embodiment described above could be made within the scope of the appended claims. The holder 10 as well as the wells 16 could be differently shaped. It is important, however, that a resiliently displaceable or flexible latching means is associated with each of the apertures of the holder for engaging with a depression formed in the peripheral outer surface of the well when it has been fully inserted.

What is claimed is:

1. A microtitration system, comprising:

a plurality of wells (16) each having a bottom wall (19) and a side wall (20) extending upwardly therefrom and defining an upper end, a groove (22) being formed in an outer surface of the well side wall at a position spaced from the bottom wall, and a holder (10) defining a plurality of apertures (13) for releasably receiving the wells (16) therein, each aperture (13) being at least partly defined by a resilient aperture defining means (14, 15), which is adapted to enter into locking engagement with the groove (22) of a well (16) received in the aperture (13), the dimensions and shape of each aperture (13) being such that when inserting a well (16) into the aperture (13), the aperture defining means (14, 15) engages against the outer surface of the well side wall (20) and is pressed radially outwardly in relation to a central axis of the well (16) until the aperture defining means (14, 15) snaps radially inwardly into locking engagement with the groove (22) formed in the side wall (20) of the well (16) when registering with the groove (22).

2. A system according to claim 1, wherein the cross-sectional dimensions of the groove (22) are such that the resilient aperture defining means (14, 15) is substantially unstressed when engaging with the groove (22).

3. A system according to claim 2, wherein the groove (22) is annular and extends along the total outer periphery of the side wall (20) of the well (16).

4. A system according to claim 3, wherein the outer surface of the side wall (20) of each well (16) is a surface of revolution.

5. A system according to claim 4, wherein each well (16) tapers towards its bottom wall (19).

6. A system according to claim 2, wherein the groove (22) is defined by an inner groove bottom wall, an upper groove side wall (25), and a lower groove side wall (26) of which side walls the latter defines an acute angle with a central axis of the well (16), whereby withdrawal of the well (16) from the holder (10) is facilitated.

7. A system according to claim 1, wherein the aperture defining means (14, 15) comprises a resiliently flexible arm (14) formed integrally with the holder (10).

8. A system according to claim 7, further comprising a latch member (15) which projects from a free end of the flexible arm (14) for engaging with the groove (22) formed in the side wall (20) of the well (16).

9. A system according to claim 8, wherein the vertical dimension of each latch member (15) is less than that of the adjacent part of the flexible arm (14) on which it is formed.

10. A system according to claim 7, wherein the apertures (13) defined by the holder (10) are arranged in parallel rows, adjacent rows being separated by a continuous, elongated frame member formed integrally with the holder (10), adjacent apertures (13) in the same row being separated by an opposed pair of oppositely directed flexible arms (14) having respective, spaced-apart free ends.

11. A system according to claim 10, wherein a number of wells (16) corresponding to the number of apertures (13) in each row are mutually interconnected by breakable connecting means (18) and form a straight row.

12. A system according to claim 11, wherein each well (16) comprises a radial flange (21) which extends from the upper open end of the well and which is provided with markings (31) for indicating the position of each well in the row.

13. A system according to claim 12, wherein said markings comprise notches (31) defined in the radial flange (21).

14. A system according to claim 10, wherein each of the opposed pair of oppositely directed flexible arms (14) comprises a latch member (15) projecting from the free end thereof for engaging with the groove (22) formed in the side wall (20) of an adjacent well (16), the respective latch members (15) of the arms in each opposed pair of arms extending transversely to the longitudinal direction of the arms and in opposite directions.

15. A system according to claim 14, wherein the vertical dimension of each latch member (15) is less than that of the adjacent part of the flexible arm (14) on which it is formed.

16. An interconnected well array for use in a microtitration system, of the type including a well holder (10) having a plurality of well-receiving openings (13), each of which has a resilient latch member (15), the well array comprising:

a plurality of wells (16) arranged in a substantially straight row and mutually interconnected by breakable connecting means (18), each well (16) having a bottom wall (19) and a side wall (20) extending upwardly therefrom and defining an open upper end; and a groove (22) formed in the outer surface of the side wall (20) of each well (16) at a position spaced from the bottom wall (19), the groove (22) being located and configured for locking engagement with the latch member (15) when the well (16) is positioned in one of the well-receiving openings (13).

17. A well array according to claim 16, wherein the groove (22) is annular and extends along the total outer periphery of the side wall (20) of each well (16).

18. A well array according to claim 17, wherein the outer surface of the side wall (20) of each well (16) is a surface of revolution.

19. A well array according to claim 18, wherein each well (16) tapers towards its bottom wall (19).

20. A well array according to claim 17, wherein the groove (22) in each well (16) has an inner bottom wall, an upper side wall (25), and a lower side wall (26) of which the latter defines an acute angle with a central axis of the well, whereby withdrawal of the well from the holder is facilitated.

21. An interconnected well array for use in a microtitration system, comprising:

a plurality of wells (16) arranged in a substantially straight row and mutually interconnected by breakable connecting means (18), each well (16) having a bottom wall (19) and a side wall (20) extending upwardly therefrom and defining an open upper end; and a radial flange (21) extending from the open upper end of each well (16) and provided with markings (31) indicating the position of each well (16) in its associated row.

22. A well array according to claim 21, wherein said markings comprise notches (31) defined in the radial flange (21).

23. A well array according to claim 22, wherein the outer surface of the side wall (20) of each well (16) is a surface of revolution.

* * * * *

UNITED STATES PATENT AND TRADEMARK OFFICE

CERTIFICATE OF CORRECTION

PATENT NO. : 5,514,343
DATED : May 7, 1996
INVENTOR(S) : Verwohlt et al.

It is certified that error appears in the above-indentified patent and that said Letters Patent is hereby corrected as shown below:

Column 6, line 9, between "upper" and "end" please insert --open--.

Signed and Sealed this

Thirteenth Day of August, 1996

*Attest:*

BRUCE LEHMAN

*Attesting Officer*

*Commissioner of Patents and Trademarks*